US006254138B1

(12) United States Patent
Rawlings et al.

(10) Patent No.: US 6,254,138 B1
(45) Date of Patent: Jul. 3, 2001

(54) SEMI-TRANSPARENT LABEL LAMINATE

(75) Inventors: Timothy W. Rawlings, Waynesville; Joseph D. Roth, Springboro, both of OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/363,603

(22) Filed: Jul. 29, 1999

(51) Int. Cl.[7] ..... B42D 15/00

(52) U.S. Cl. ..... 283/81; 283/101; 283/105; 283/109

(58) Field of Search ..... 283/79, 80, 81, 283/74, 101, 105, 107, 108, 109; 428/40.1, 41.7, 41.8, 42.2, 42.3, 43; 40/299

(56) References Cited

U.S. PATENT DOCUMENTS

| | | | | |
|---|---|---|---|---|
| 107,166 | | 9/1870 | Davis . | |
| 709,805 | | 9/1902 | Sterns et al. . | |
| 1,245,447 | | 11/1917 | Felenchak . | |
| 1,303,063 | * | 5/1919 | Houck | 283/116 |
| 2,563,340 | | 8/1951 | Kelly . | |
| 3,380,648 | | 4/1968 | De Lyra . | |
| 3,545,669 | | 12/1970 | Kinkade . | |
| 3,822,492 | | 7/1974 | Crawley . | |
| 4,159,129 | | 6/1979 | Lockhart . | |
| 4,479,838 | | 10/1984 | Dunsim et al. . | |
| 4,637,635 | | 1/1987 | Levine . | |
| 5,248,082 | | 9/1993 | Elmlinger . | |
| 5,289,972 | | 3/1994 | Saurerwine et al. . | |
| 5,360,160 | | 11/1994 | Sauerwine et al. . | |
| 5,370,302 | | 12/1994 | Dyer . | |
| 5,383,686 | | 1/1995 | Laurash . | |
| 5,413,383 | | 5/1995 | Laurash et al. . | |
| 5,476,698 | | 12/1995 | Denny . | |
| 5,520,990 | * | 5/1996 | Rotermund | 283/105 X |
| 5,547,227 | | 8/1996 | Laurash et al. . | |
| 5,580,640 | | 12/1996 | Kraft et al. . | |
| 5,630,627 | * | 5/1997 | Stewart | 283/105 X |

FOREIGN PATENT DOCUMENTS

| | | |
|---|---|---|
| 0274225 | 7/1988 | (EP) . |
| 0329370 | 8/1989 | (EP) . |
| 2177373 | 1/1987 | (GB) . |

OTHER PUBLICATIONS

Roth et al., US Patent Application, "Nested Label", filed concurrently herewith (NCR Docket No. 8233).
Rawlings, US Patent Application, "Returnable Mailer", US Serial No. 09/261,779; filed Mar. 3, 1999 (NCR Docket No. 8174).
Rawlings, US Patent Application, "Returnable Shipping Label", US Serial No. 09/261,780; filed Mar. 3, 1999 (NCR Docket No. 8175).
Wallace.com, "New Product Announcements", two page website printed May 1999.

* cited by examiner

*Primary Examiner*—Willmon Fridie, Jr.
(74) *Attorney, Agent, or Firm*—Francis L. Conte

(57) ABSTRACT

A label laminate includes a label for printing a recipient first address, with a release liner disposed thereunder. The label is releasably bonded to the liner and is removable therefrom. The liner is transparent to view a recipient second address hidden behind the label until removed.

24 Claims, 8 Drawing Sheets

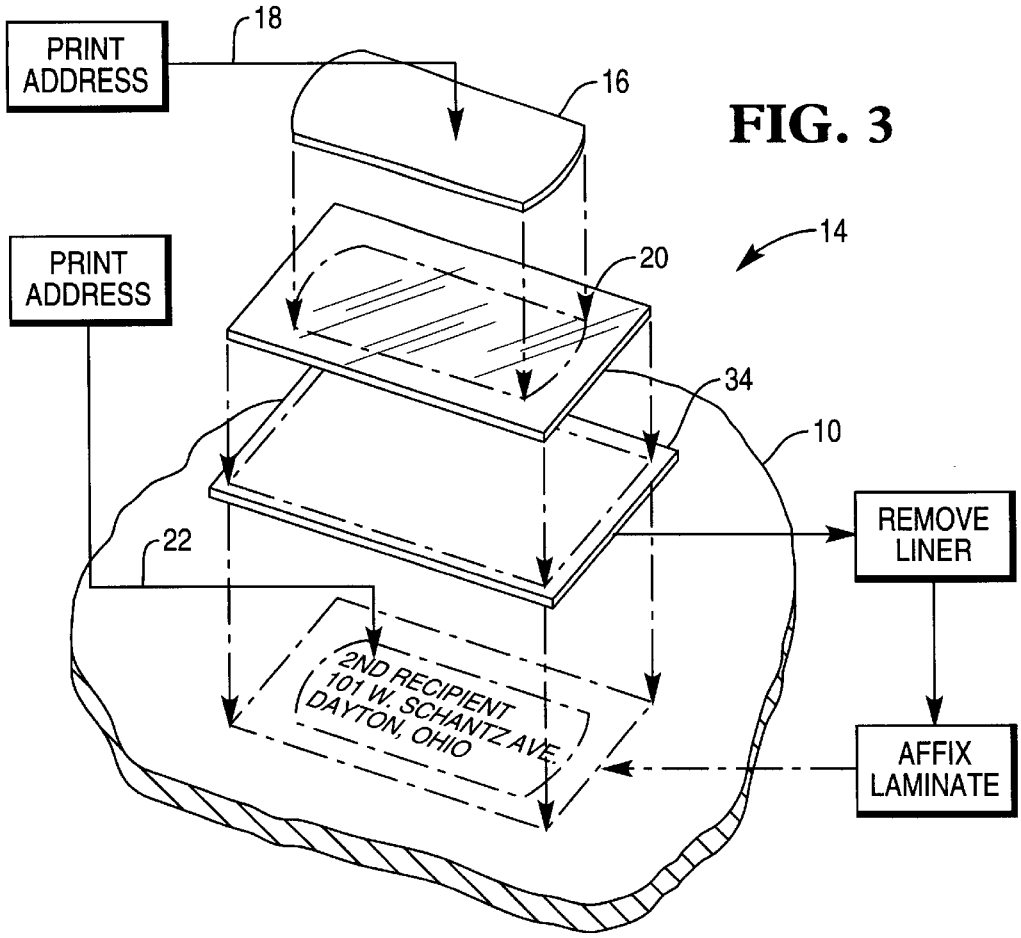
FIG. 3
FIG. 4
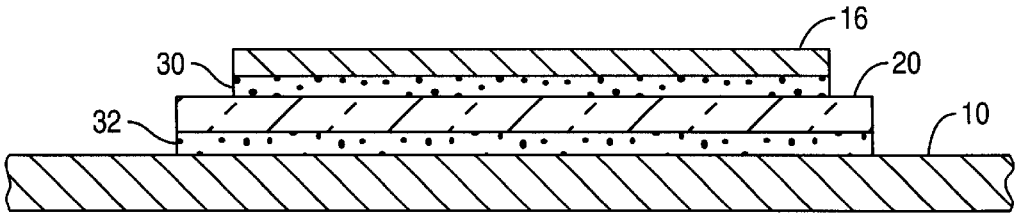

SEMI-TRANSPARENT LABEL LAMINATE

BACKGROUND OF THE INVENTION

The present invention relates generally to labels, and, more specifically, to address labels.

Mailers are available in various configurations and sizes for sending various items from a sender at one address to recipient at another address. A typical mailer is in the form of a container such as a flat envelope, rectangular box, or a cylindrical tube, for example, in which paper correspondence or three dimensional articles may be packaged for delivery.

Recipient and return addresses may be printed directly on the mailers, or may be applied thereto in the form of pressure sensitive labels. Such labels are commonly found in a string or sheet of multiple labels permitting batch addressing to various recipients, commonly from a single sender.

A typical label sheet is a laminate containing several labels adhesively bonded to a common underlying release liner, typically referred to as pressure sensitive labels. Correspondence addresses may be printed on the individual labels in a suitable printer, with the labels then being individually peeled from the liner and affixed to corresponding mailers using the same adhesive found on the back side of the labels. The mailer may then be suitably shipped through the U.S. Postal Service, or private carrier, or local courier to the intended recipient.

When containers are used to ship merchandise to a customer, it is common for the customer to use the same container to return to the sender the merchandise when it fails to meet requirements. The original recipient address must then be obliterated by being either removed or marked over, or a new label may be affixed over the original recipient address. Should the container have a separate return address thereon from the original sender, that return address must also be removed or supplanted.

The quality and security of the replacement addresses on the same container may vary significantly depending on the care and method used for readdressing. In the worst case, a reapplied label may fall off during the return trip of the container, and interrupt the delivery.

Accordingly, it is desired to provide an improved shipping label for both sending a container to a recipient, and returning the same container to a second recipient, such as the original sender.

BRIEF SUMMARY OF THE INVENTION

A label laminate includes a label for printing a recipient first address, with a release liner disposed thereunder. The label is releasably bonded to the liner and is removable therefrom. The liner is transparent to view a recipient second address hidden behind the label until removed.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which:

FIG. 3 is an exploded view of the shipping label illustrated in FIG. 1 and a corresponding flowchart for its manufacture and use in addressing the container.

FIG. 4 is an elevational sectional view through the shipping label illustrated in FIG. 1 and taken along line 4—4.

DETAILED DESCRIPTION OF THE INVENTION

Figure 1:
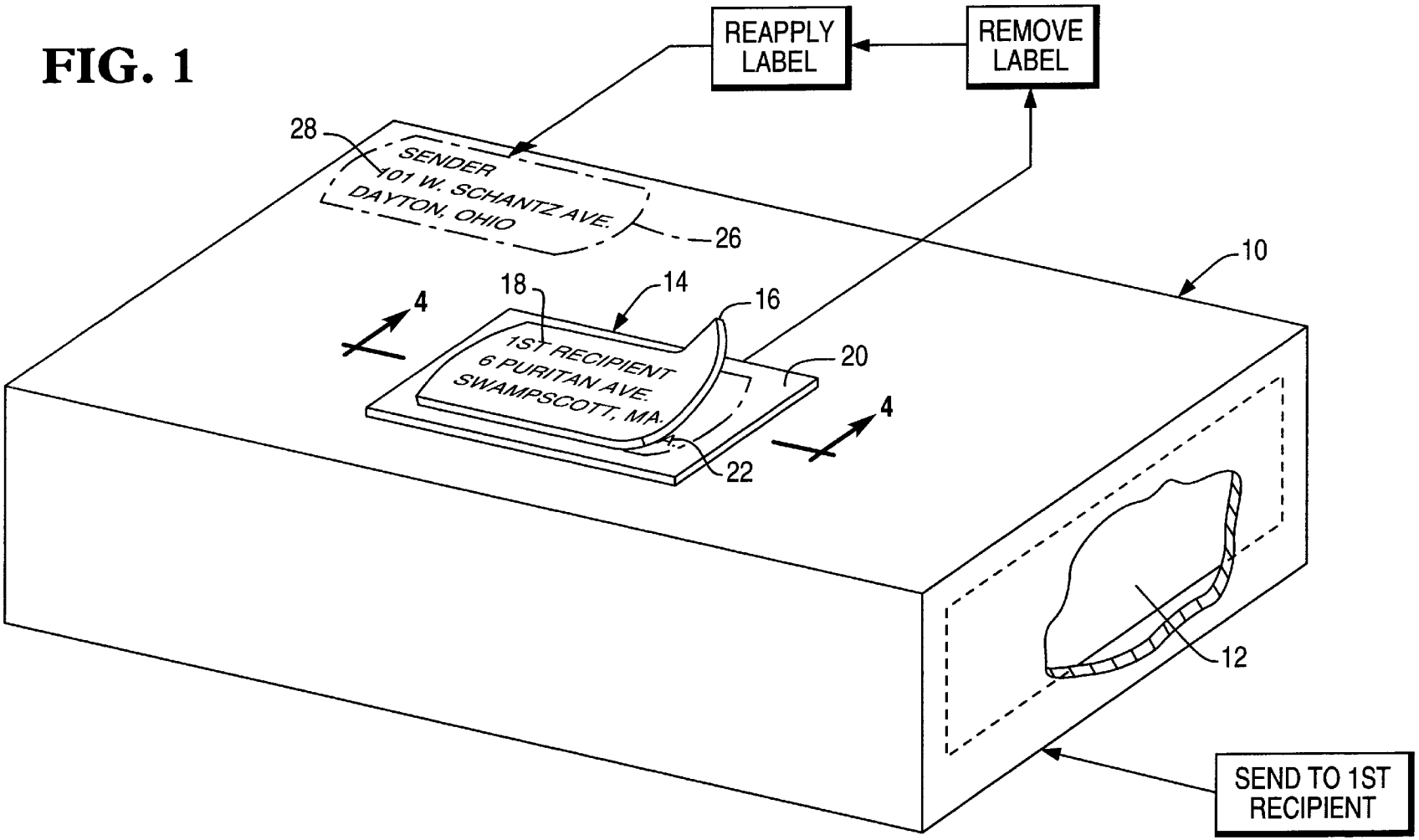
FIG. 1 is an isometric view of an exemplary shipping container having a shipping label in accordance with an exemplary embodiment of the present invention.

Illustrated in FIG. 1 is a shipping container 10 configured for shipping an item or article 12 to a recipient. The container may take any conventional form such as the rectangular box illustrated, or a cylindrical shipping tube, or flat envelopes, for example. The article 12 may have any conventional form such as merchandise, or written correspondence of one or more sheets, for example. And, the container may be mailed or shipped using any suitable means such as U.S. Postal Service, or private carrier, or local courier, for example.

A shipping label or laminate 14 is provided in accordance with one embodiment of the present invention for attachment to the container for identifying the recipient, as well as permitting re-shipment of the same container to a second recipient, which may be the original sender. The laminate 14 includes a pressure sensitive address label 16 having a front face or surface upon which may be printed a recipient first address 18.

A release liner 20 is initially disposed under the label 16, with the label being releasably bonded thereto by a suitable adhesive covering the back side or surface of the label. The liner may have any conventional configuration including a release agent, such as silicone, coated thereon for permitting removal of the label by being peeled away therefrom. The adhesive typically used for pressure sensitive labels is permanently bonded to the label back and is releasable from the liner so that the label may be reapplied to other surfaces as desired.

Figure 2:
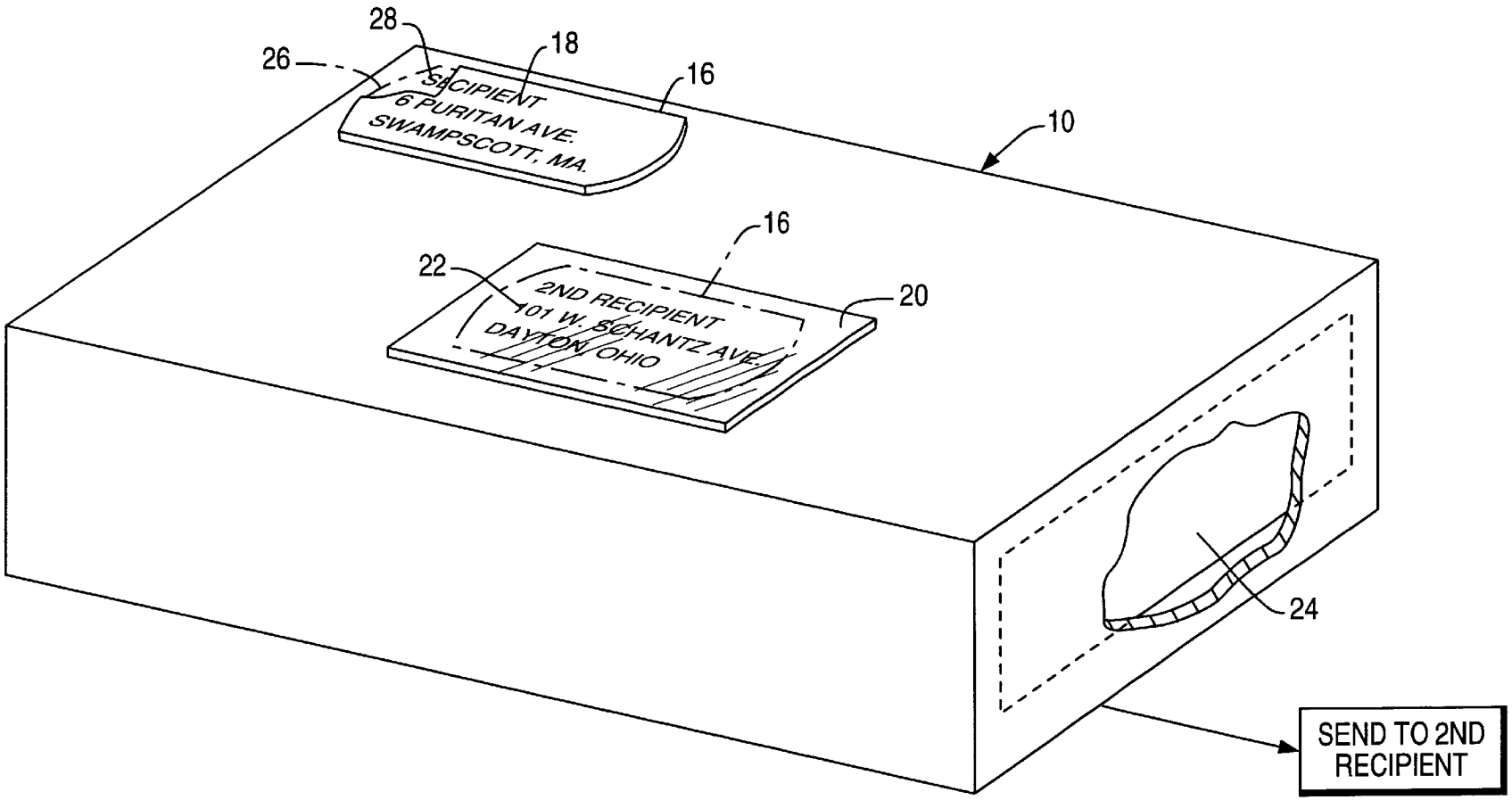
FIG. 2 is an isometric view of the container illustrated in FIG. 2 with the shipping label removed from an underlying liner and reaffixed atop the return address for returning the container to the sender.

FIG. 1 illustrates the label 16 being removed from the liner 20 for exposing therebelow a recipient second address 22, more clearly shown in FIG. 2 after removal of the label.

In accordance with the present invention, the label 16 is opaque and the liner 20 is transparent so that the second address 22 printed between the liner and container is initially hidden behind the label until the label is removed to expose to view the second address disposed therebelow. In this way, the shipping label is semi-transparent, or transparent only through its clear liner while being opaque through its label.

The liner 20 may have any conventional composition to provide its transparency, preferably fully transparent so that the initially hidden second address may be clearly viewed therethrough. For example, the liner may be formed of a suitable plastic such as polyetheleneterephthalate, glassine paper, or supercalendered and thin machine glazed paper.

In a typical method of use illustrated in FIG. 3, the first address 18 is suitably printed atop the label 16 as required for each container shipment. The second address 22 is printed between the liner and container, and preferably directly atop the container 10 in one embodiment. In this way, any conventional printing means may be used to print the two addresses either by printer or by hand with any addresses or print desired.

The shipping laminate 14 is then suitably affixed to the container so that the container may then be shipped or sent to the first address 18 viewable atop the label 16.

The intended recipient may, for various reasons, desire to re-use the same container 10 for returning the same item 12 to the original sender, or a different item or article 24, as illustrated in FIG. 2, to the original sender or to an alternate recipient. The container itself may be opened and re-closed in any suitable manner for removing the original article 12, and either repacking that article or the second article 24 in the same container for reshipment.

Once the container is repackaged, the recipient may simply remove the original label 16 from the liner 20 to expose the second address 22 hidden therebelow as illustrated in FIGS. 1 and 2. The second address 22 may be the original sender, and the container may then be re-sent to the second address for return to the sender. Since the liner 20 remains attached to the container 10 it supports the original label 16 during the original shipment to the recipient, and then upon removal of the original label 16, the clear liner 20 and printing therebelow provide a preaddressed return label for reshipping the same container to the specified second address 22.

An additional advantage of using the pressure sensitive label 16 is that once the label 16 is removed from the container it may be reapplied to the same container at a different location away from the liner 14. As initially shown in FIG. 1, the container 10 typically also includes a return area or zone 26 at a suitable location spaced away from the shipping laminate 14 in which a return address 28 may be suitably printed.

In a preferred embodiment, the removed label 16 is reapplied atop the return zone 26 as shown in FIG. 2 to hide or cover the original return address 28, which is then supplanted by the first address 18 already printed on the label 16. That first address 18 identifies the original recipient from whom the container is subsequently being reshipped to the second address 22.

The original shipping laminate 14 therefore provides two integrated address labels, including the top label 16 and the underlying clear liner 20 itself, for addressing the container to the original recipient, as well as addressing the container to the second address by simply removing the label 16 and reapplying it over the return zone 26 if desired.

A sectional view of the shipping laminate 14 affixed atop the container 10 is illustrated in more detail in FIG. 4. The label 16 and liner 20 are typically flat sheets having opposite sides or surfaces defining the fronts and backs thereof. The label 16 includes a first or label adhesive 30 disposed between the label back and the liner front. The adhesive is conventional and is permanently bonded to the label, but releasably bonded to the underlying liner.

The liner back includes a second or liner adhesive 32 which may have any suitable composition for bonding or affixing the liner 20 to the container 10. The liner adhesive 32 may be a gum adhesive initially permanently bonded to the liner back which may be suitably wetted for bonding the liner back to the container.

Suitable means are provided for affixing the liner and its attached label to the container. In a preferred embodiment illustrated in FIG. 3, the affixing means include a second release liner 34 disposed under the label liner 20, which defines a first liner. The back of the first liner 20 is releasably bonded to the front of the second liner 34 by the adhesive 32, with the first liner 20 itself being in the form of a typical pressure sensitive label. The front of the second liner 34 has a suitable release coating such as silicone for permitting the second liner 34 to be removed from the back of the first liner 20 so that the first liner 20 and attached label 16 may be bonded or affixed at any suitable location atop the container 10 illustrated in FIG. 1.

The individual shipping laminate 14 is an assembly of the label 16 atop the first liner 20, and optionally the second liner 34 in a piggyback label construction. The laminate may be manufactured in any conventional manner typically from a continuous roll of face stock which defines a series of the labels 16 laminated with first and second liners 20,34 as desired, with the adhesives 30,32 being extruded therebetween during the laminating process.

The individual shipping laminates 14, including the label 16 atop the first liner 20 atop the second liner 34, may be configured in groups on common sheets for use in a typical laser printer. The label sheet may include any suitable number of the individual shipping laminates 14 in one or more rows for providing multiple labels for corresponding shipping containers.

In use, the recipient first address 18 is printed atop the individual label 16, and the recipient second address 22 is printed atop the container 10. The first and second liners 20,34 are then separated for permitting the first liner 20 to be attached to the container, with the label 16 being integrated therewith. The container may then be shipped to the recipient, and the recipient may readily peel away the original label 16 to expose the recipient second address 22 through the clear liner 20 for reshipping the same container thereto. The removed label 16 may be reapplied atop the return zone 26 as illustrated in FIG. 1 to cover the original return address with the original recipient address, which now identifies the new return address.

In a typical label sheet containing multiple shipping laminates of the type illustrated in FIG. 3, the second release liner 34 will preferably be continuous over the full extent of the sheet. The individual label 16 and integrated release liners 20 thereunder may have perimeters suitably die cut from their neighbors. In this way, each shipping label defined by the assembly of the address label 16 and supporting first release liner 20 may be peeled away collectively from the underlying second liner 34 and reapplied to a corresponding container using the same adhesive 32 found on the back of the liner. Similarly, when the label 16 is removed from the liner 20 by the recipient, the same adhesive 30 found on the back of the label 16 is used for reapplying the label at a different location atop the container.

The shipping label disclosed above improves the efficiency of reusing the same container 10 using the preaddressed label and underlying clear liner. The simple removal of the label 16 from its liner atop the container and its reattachment over the original return address is easily and effectively accomplished. Both the original first liner 20 and the label 16 are thusly permanently bonded to the container for ensuring successful return of the container to the intended second recipient.

Figure 5:
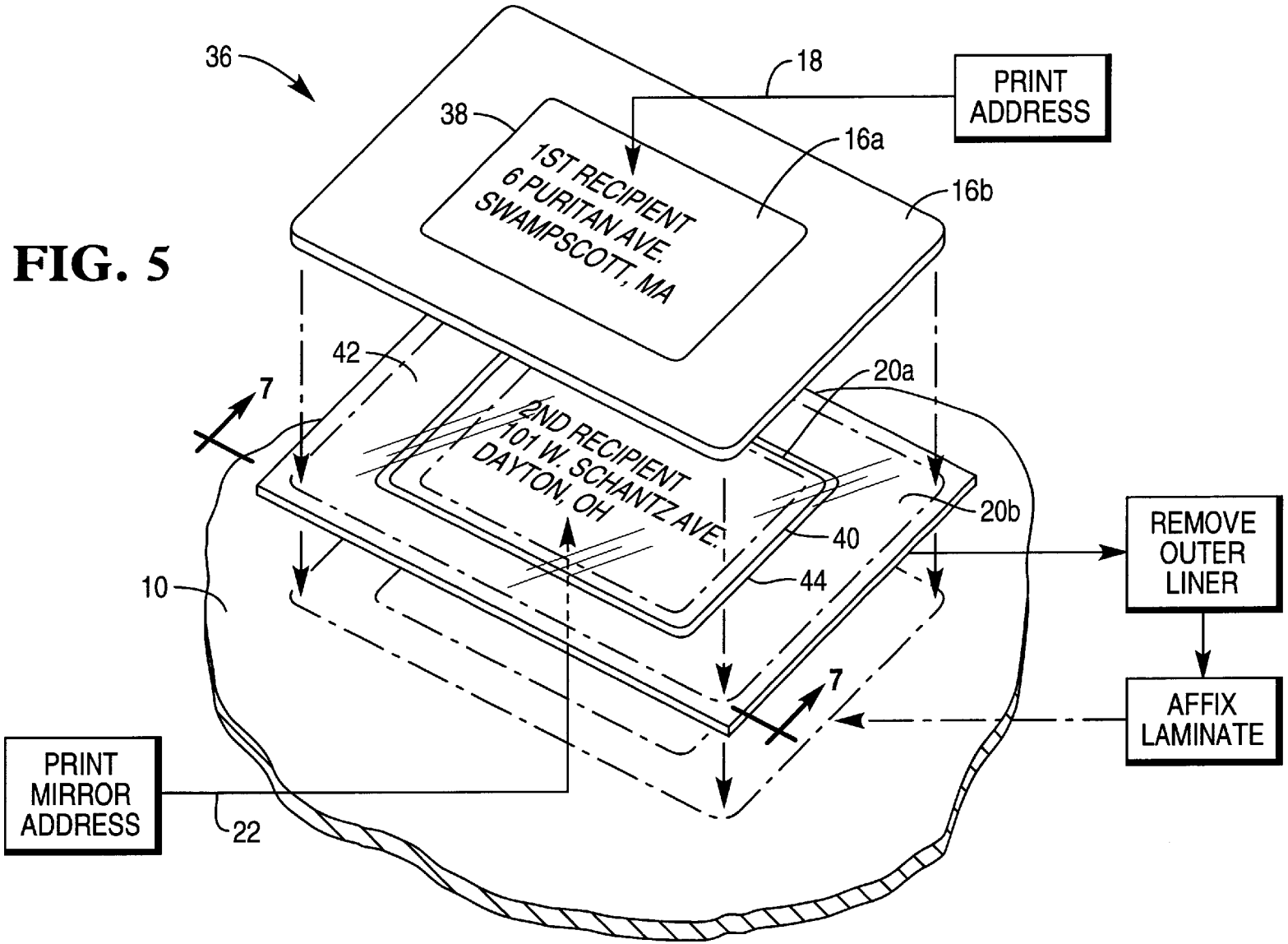
FIG. 5 is an exploded view of the shipping label and a corresponding flowchart for its manufacture and use in addressing the container in accordance with another embodiment of the invention.

Illustrated in FIG. 5 is another embodiment of the semi-transparent shipping label or laminate 36 in the form of a nested label-in-label. The face sheet label includes a central inner label 16*a* adjoining a coplanar outer label 16*b* which provides a border around the full perimeter of the inner label. The inner label is suitably sized for receiving the first address 18 printed thereatop.

The underlying transparent liner correspondingly includes a central inner liner 20*a* adjoining a coplanar outer liner 20*b* which provides a border around the full perimeter of the inner liner. The inner liner is transparent for viewing the second address 22 therethrough, and may be formed of the exemplary materials disclosed above. The outer label and adhesive thereon effect the means for affixing the inner liner and full label to the container upon removal of the outer liner.

The inner label 16*a* is severed from the outer label 16*b* by a corresponding label die cut 38 around the full perimeter of the inner label for permitting later removal of the inner label. The outer liner 20*b* is severed from the inner liner 20*a* by a corresponding liner die cut 40 around the full perimeter of the inner liner for permitting later removal of the outer liner.

In this embodiment, the first address 18 is suitably printed atop the inner label 16*a*. The second address 22 is suitably printed on the exposed back side of the inner liner 20*a*. In order to properly view the second address disposed on the back side of the inner liner 20*a*, the second address is printed thereon backwards, or in mirror reverse image. The reverse printed second address 22 is shown in FIG. 6, with FIG. 5 showing the normal, forward printed second address when viewed through the clear inner liner.

Figure 6:
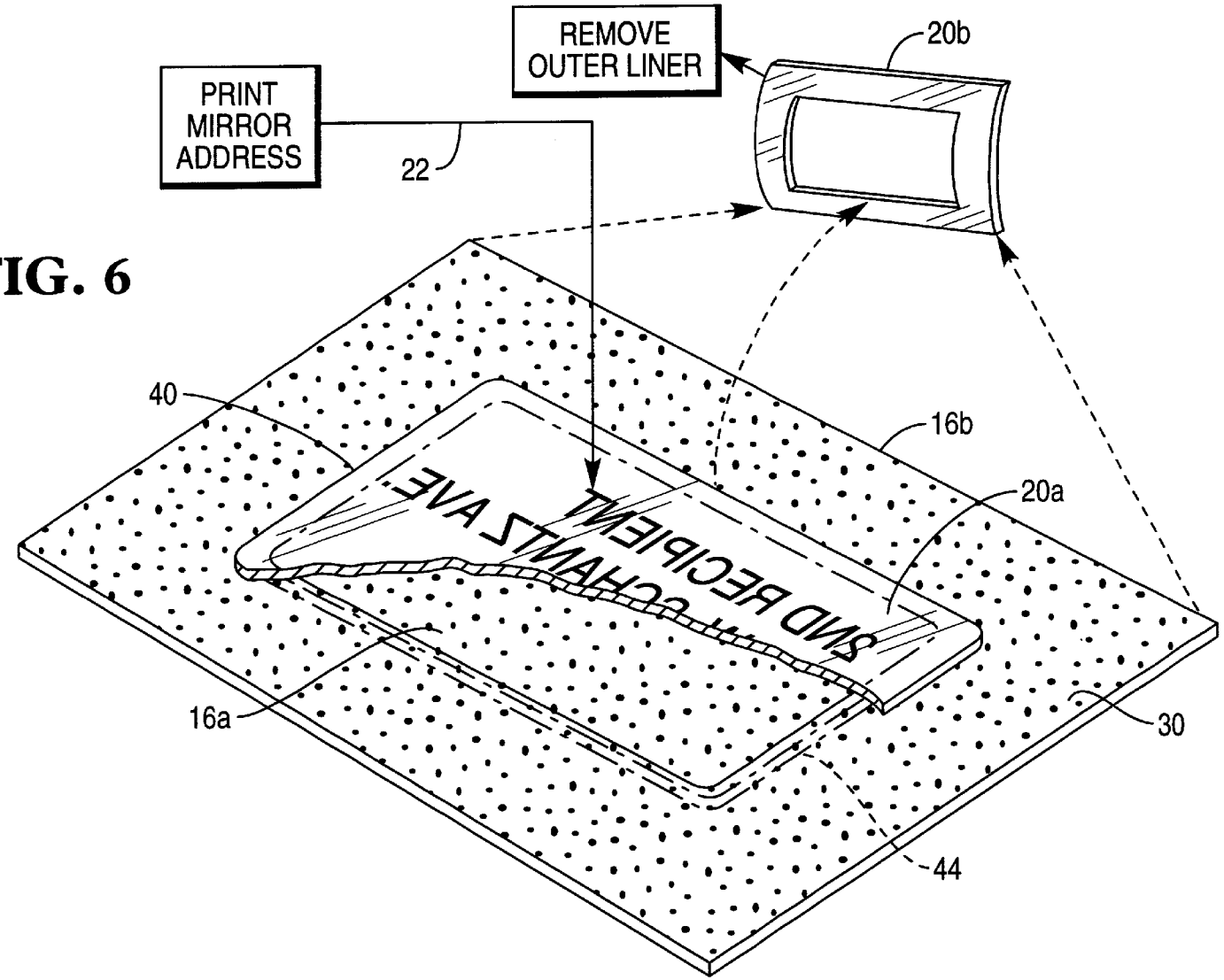
FIG. 6 is a partly sectional, underside view of the shipping label illustrated in FIG. 5 showing printing of an inner liner, and removal of an outer liner thereof for affixing to the container.

FIG. 6 also illustrates the removal of the outer liner 20*b* from the outer label 16*b* which separates from the inner liner 20*a* due to the perimeter die cut 40. The back sides of the coplanar inner and outer labels 16*a,b* contain the pressure sensitive adhesive 30 thereon, which is then exposed around the outer label. The remaining laminate is then attached to the container 10 by affixing the outer label 16*b* to the container using the exposed adhesive under the outer label.

Figure 7:
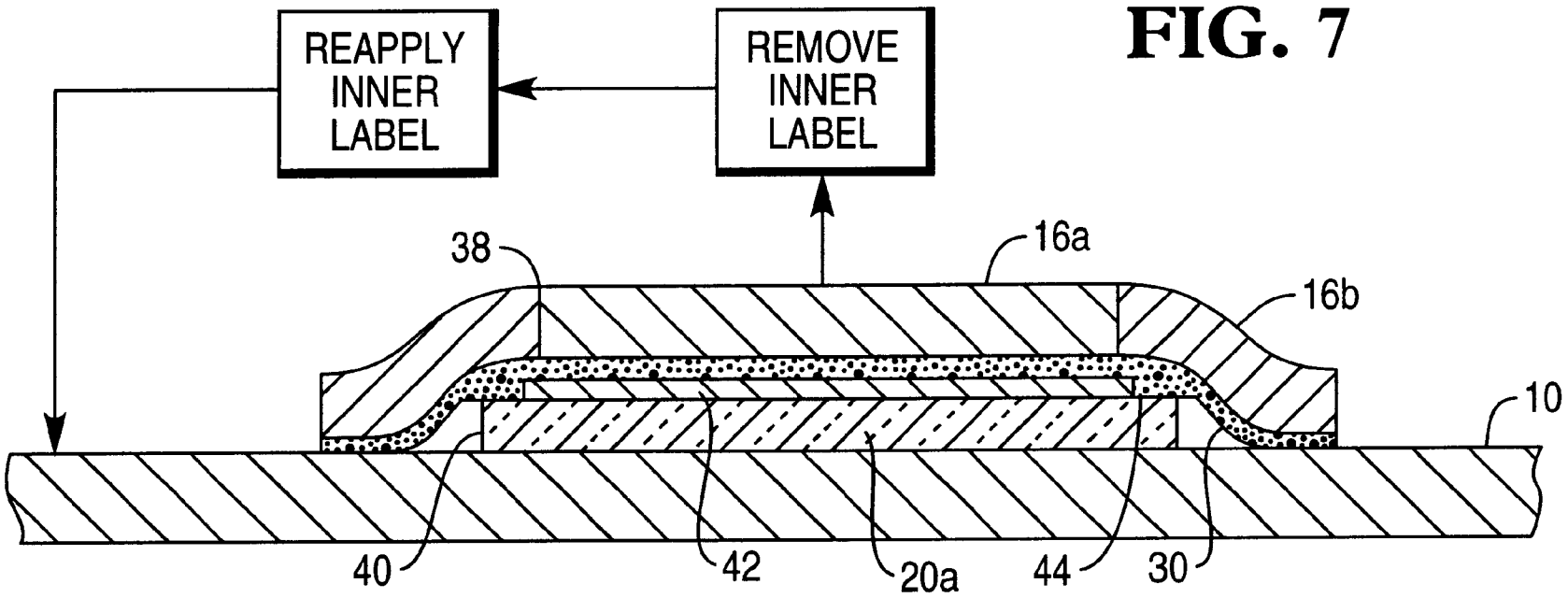
FIG. 7 is an elevational sectional view of the shipping label illustrated in FIG. 5 and taken along line 7—7.

The inner label 16*a* stays attached to the outer label by the underlying inner liner 20*a* which provides a bridge therebetween, with the inner liner being trapped atop the container by the outer and inner labels as shown in FIG. 7. The opaque inner label 16*a* hides from view both the inner liner 20*a* and the second address 22 printed therebelow.

As shown in FIGS. 5 and 7, the inner and outer liners 20*a,b* include a surface release or agent 42, such as silicone, coated on the front sides thereof to provide a low friction bond with the label adhesive 30 to permit removal of the label from the liners for re-bonding on the container, for example. In a preferred embodiment, the inner liner 20*a* is slightly larger than the inner label 16*a* laminated therewith to overlap the inner perimeter of the outer label 16*b*, and includes a skip 44 devoid of the release around the perimeter of the inner label 16*a*. In this way, the label adhesive 30 will permanently bond the inner liner 20*a* to the outer label 16*b* along the skip 44 extending just outside the label die cut 40. This bridging of the inner liner to the outer label improves integrity of the shipping laminate as the outer liner is peeled away during the application process.

Once the container is addressed using the shipping label, it may then be sent to the first address 18 by any suitable carrier. The recipient then may re-use the same container as explained above, and remove the inner label 16*a* from the trapped inner liner 20*a* to expose the second address now viewable through the clear inner liner. The container can then be resent to the visible, pre-printed, second address 22.

The removed inner label 16*a* may then be reapplied to the container as shown in FIG. 7 using the same adhesive on its back side. The re-bonded inner label 16*a* is suitably positioned away from the inner liner 20*a*, such as to cover the original return address 28 in the same manner as shown in FIGS. 1 and 2.

The particular advantage of the nested shipping label 36 over the piggyback shipping label 14 is that it may be printed on both sides, i.e. the liner and label, in any convenient manner prior to attachment to the container. The nested labels may be printed in groups en masse for attachment to corresponding containers being sent en masse. And, any suitable printer may be used for increasing speed of labeling.

Figure 8:
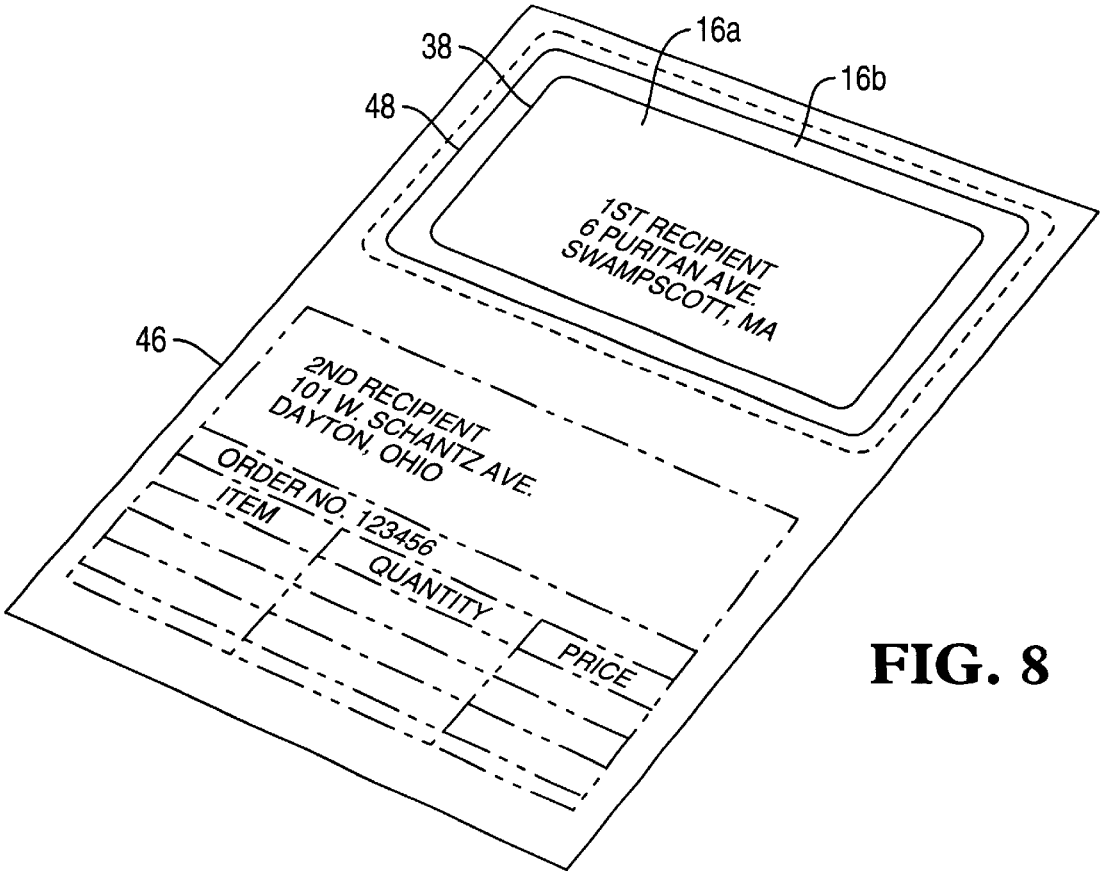
FIG. 8 is an isometric view of a nested label integrated with a form sheet in accordance with another embodiment of the invention.
Figure 9:
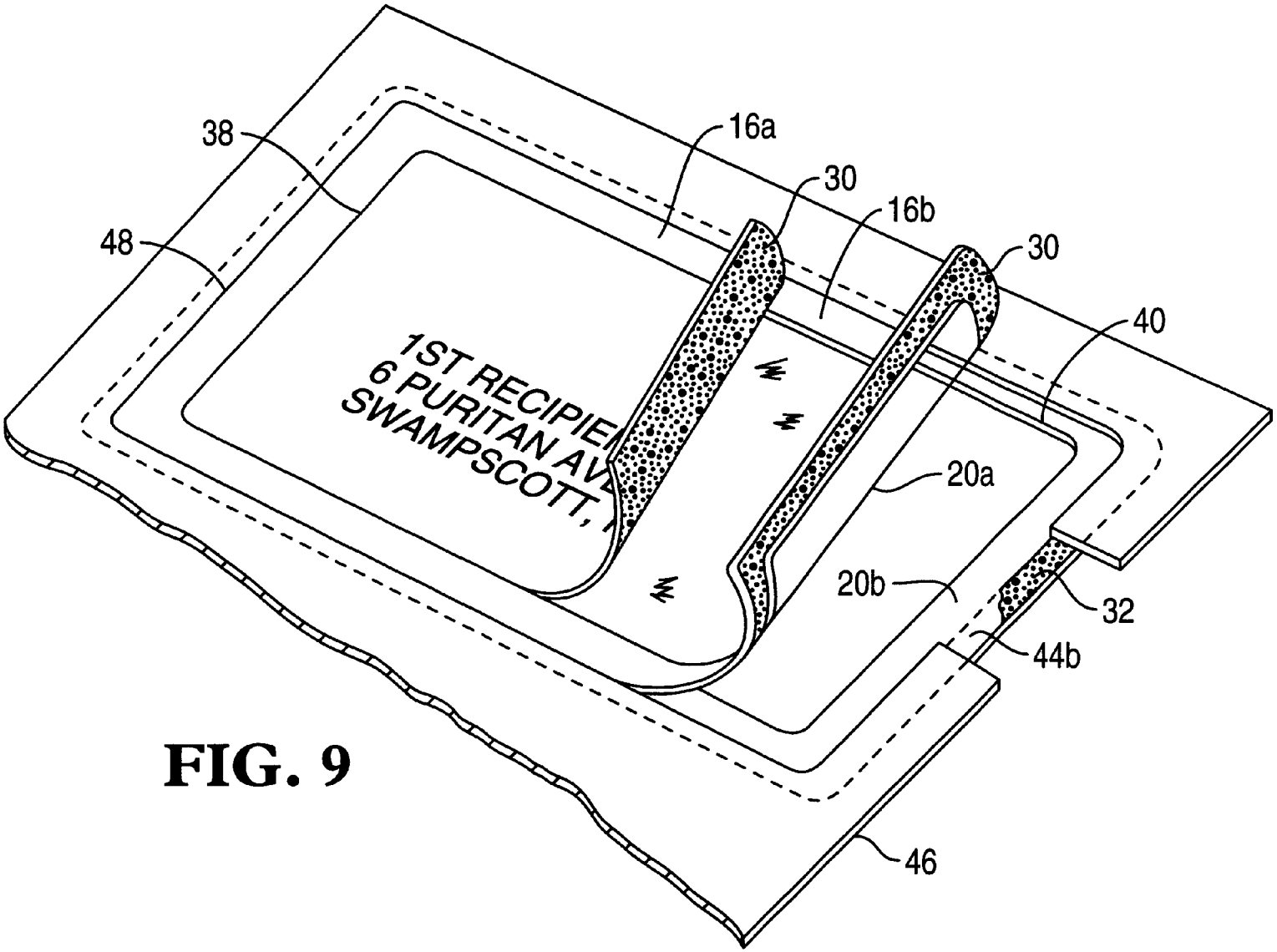
FIG. 9 is an enlarged, partly exploded, view of the nested label and surrounding form sheet illustrated in FIG. 8.

Illustrated in FIGS. 8 and 9 is another embodiment of the present invention in which the semi-transparent label laminate may be integrated with a form sheet 46. In this example, the nested label-in-label illustrated in FIGS. 5–7 is integrated with the form sheet 46. In another example (not shown), the piggyback label illustrated in FIGS. 1–4 may be integrated with the form sheet.

Preferably, the label 16*a,b* is integrated with the form sheet 46 in a unitary or one-piece sheet of face stock, of any suitable size, such as 8.5 by 11 inch paper. In this way, various advantages accrue therefrom, particularly in commercial sales transactions.

For example, the form sheet itself may be printed with any suitable information thereon for the sales transaction, such as listing one or more items being purchased by a customer, and providing a shipping label 16*a,b* for addressing the shipping package for the item(s). Since shipping agents typically require shipping labels to conform to their specifications, such as minimum size, more usable area remains on the form sheet by integrating both the shipping label and the return label in the same area on the form, instead of using two side-by-side labels for such purposes.

The dual purpose shipping/return label 16*a,b* is simply integrated in the common form sheet 46 by providing a border die cut 48 therein for severing the perimeter of the outer label 16*b* therefrom. The inner label 16*a* is severed from the outer labels 16*b* by its perimeter die cut 38. The inner label 16*a* is provided to print thereon the first recipient address as the remainder of the form sheet is being printed.

The inner and outer labels 16*a,b* are removably adhesively bonded to corresponding inner and outer liners 20*a,b* which include the severing liner die cut 40 therebetween and the surface release thereon as in the FIGS. 5–7 embodiment. As shown in FIG. 9, the perimeter of the outer liner 20*b* overlaps the back of the form sheet 46, and is fixedly joined thereto.

The perimeter or border of the outer liner 20*b*, where it overlaps the form sheet, preferably includes a border or outer skip 44*b* devoid of the surface release so that adhesive 32 may be used therebetween to fixedly bond the outer liner to the form sheet. Similarly, the inner liner 20*a* includes the same inner skip 44 shown in FIGS. 6 and 7 devoid of the surface release for fixedly bonding the outer label 16*b* thereto with the adhesive 30.

In this way, both labels 16*a,b* are securely joined to the form sheet, with the liners bridging the die cuts 38,48 for maintaining structural integrity. And, the outer label 16*b* remains securely attached to the inner liner 20*a* when they are applied to the shipping container in the same manner shown in FIG. 7.

In the FIG. 9 embodiment, the two labels 16*a,b* are removed together from the outer liner 20*b,* which remains attached to the form sheet maintaining integrity thereof. The inner liner 20*a* remains attached to the two labels. The two labels are then applied to the shipping container to trap the inner liner 20*a* thereatop in the same manner shown in FIG. 7. And, the container is then normally shipped.

The first recipient may then reuse the same container by peeling off the inner label 16*a* and discarding it or re-applying it to the return zone of the container. Since the inner liner 20*a* is transparent, the second recipient address is again viewable therethrough, either printed normally on the container itself, or printed backwards on the back of the inner liner.

In these various embodiments, the clear liner permits see-through access to the underlying second address for using the same shipping label for two in-turn shipments of the same container. The improved semi-transparent label laminate may also be used in other applications where desired to print different information atop the label and therebelow.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention. For example, the outer label illustrated in FIG. 5 need not fully surround the inner label. Any side of the inner label may extend to the corresponding edge of the laminate.

Accordingly, what is desired to be secured by Letters Patent of the United States is the invention as defined and differentiated in the following claims.

What is claimed is:

1. A shipping laminate for addressing a shipping container comprising:

a label for printing thereatop a recipient first address;

a transparent release liner disposed under said label, with said label being releasably bonded thereto; and a recipient second address printed below said liner and above said container and viewable through said liner.

2. A method of using said shipping laminate according to claim 1 comprising:

printing said first address atop said label;

printing said second address between said liner and container;

affixing said laminate to said container;

sending said container to said first address;

removing said label from said liner to expose said second address through said liner; and resending said container to said second address.

3. A method according to claim 2 further comprising reapplying said removed label to another location on said container away from said liner.

4. A method according to claim 3 wherein:

said container includes a return zone having a return address thereon; and said removed label is reapplied atop said return zone to cover said return address.

5. A laminate according to claim 1 wherein:

said liner includes a front and an opposite back;

said label includes an adhesive between said label and said liner front; and further comprising means for affixing said liner to said container.

6. A laminate according to claim 5 wherein said affixing means comprise:

said liner back including an adhesive for bonding said liner to said container; and a second release liner disposed under said label liner which label liner defines a first liner, with said first liner being releasably bonded to said second liner.

7. A method of using said shipping laminate according to claim 6 comprising:

printing said first address atop said label;

printing said second address atop said container;

removing said second liner from said first liner;

affixing said first liner to said container;

sending said container to said first address;

removing said label from said first liner to expose said second address viewable therethrough; and resending said container to said second address.

8. A method according to claim 7 further comprising reapplying said removed label to said container away from said liner.

9. A method of using said shipping laminate according to claim 5 comprising:

printing said first address atop said label;

printing said second address atop said container; and affixing said laminate to said container.

10. A laminate according to claim 5 wherein:

said label includes an inner label, for receiving said first address, adjoining an outer label at a label die cut;

said liner includes a transparent inner liner, for viewing said second address therethrough, adjoining an outer liner at a liner die cut; and said outer label and adhesive thereon effect said affixing means.

11. A laminate according to claim 10 wherein:

said inner label is severed from said outer label by said label die cut for removal therefrom; and said outer liner is severed from said inner liner by said liner die cut for removal therefrom.

12. A laminate according to claim 11 wherein said second address is disposed on said back of said inner liner.

13. A laminate according to claim 11 wherein:

said inner and outer liners include a surface release on said front thereof; and said inner liner includes a skip devoid of said release around said inner label for fixedly bonding said outer label thereto.

14. A laminate according to claim 11 wherein said second address is disposed backwards on said back of said inner liner.

15. A method of using said shipping laminate according to claim 10 comprising:

printing said first address atop said inner label;

printing said second address atop said back of said inner liner; and affixing said outer label to said container to trap said inner liner thereatop and hide said second address behind said inner label.

16. A method according to claim 15 further comprising:

sending said container to said first address;

removing said inner label from said inner liner to expose said second address viewable therethrough; and resending said container to said second address.

17. A method according to claim 16 further comprising reapplying said removed inner label to said container away from said inner liner.

18. A laminate according to claim 5 further comprising a form sheet integrated with said label and extending away therefrom.

19. A laminate according to claim 18 wherein said label and form sheet comprise a unitary sheet including a border die cut therein for severing said label from said form sheet.

20. A laminate according to claim 19 wherein:

said label includes an inner label, for receiving said first address, adjoining an outer label at a label die cut, and said border die cut bounds said outer label;

said liner includes a transparent inner liner, for viewing said second address therethrough, adjoining an outer liner at a liner die cut, and said outer liner is fixedly joined to said form sheet; and said outer label and adhesive thereon effect said affixing means.

21. A laminate according to claim 20 wherein:

said inner and outer liners include a surface release on said front thereof; and said outer liner includes a skip devoid of said release around a border thereof for fixedly bonding said outer liner to said form sheet with an adhesive.

22. A laminate according to claim 20 wherein said inner liner includes a skip devoid of said release around said inner label for fixedly bonding said outer label thereto with said adhesive.

23. A semi-transparent label laminate comprising:

an inner label adjoining a coplanar outer label at a label die cut therearound; and a transparent inner liner adjoining an outer liner at a liner die cut therearound, with said inner and outer liners being releasably bonded to said inner and outer labels, respectively by an adhesive disposed on backs of said labels.

24. A laminate according to claim 23 wherein:

said inner and outer liners include a surface release on fronts thereof; and said inner liner includes a skip devoid of said release around said inner label for fixedly bonding said outer label thereto with said adhesive.

* * * * *